US005251418A

United States Patent [19]

Jacobs et al.

[11] Patent Number: 5,251,418

[45] Date of Patent: Oct. 12, 1993

[54] PANEL DOOR FRAME ASSEMBLY

[75] Inventors: Kenneth Jacobs, Bramley, England; Torsti T. T. Jerila, West Covina, Calif.

[73] Assignee: The Stanley Works, New Britain, Conn.

[21] Appl. No.: 731,411

[22] Filed: Jul. 17, 1991

[51] Int. Cl.[5] ..... E04B 9/00

[52] U.S. Cl. ..... 52/475; 52/773; 52/775

[58] Field of Search ..... 52/773, 774, 775, 769, 52/397, 401, 718, 766, 208

[56] References Cited

U.S. PATENT DOCUMENTS

| | | | |
|---|---|---|---|
| 2,638,191 | 5/1953 | Menosky | 189/78 |
| 2,795,306 | 6/1957 | Fey et al. | 189/78 |
| 2,807,339 | 9/1957 | Wagner | 189/78 |
| 2,813,313 | 11/1957 | Shrode | 20/56.4 |
| 2,838,148 | 6/1958 | Fox-Williams et al. | 189/78 |

*Primary Examiner*—Carl D. Friedman

*Assistant Examiner*—Creighton Smith

*Attorney, Agent, or Firm*—Christie, Parker & Hale

[57] ABSTRACT

A frame assembly for fastening a stile onto a door panel comprises an edge frame member and a spring retainer. The edge frame member has a door panel channel which receives a door panel and a retainer channel which receives a retainer. The retainer channel has a heel and a shoulder projecting inwardly into the channel from opposite walls. The edge frame member also has a support edge which faces the door panel channel. The retainer has a U-shaped mounting end which snaps into the retainer channel, engaging the heel and the flange. A resilient deflection arm extends out of the channel away from the mounting end, contacts the supporting edge and bends outward into the door panel channel so that when a door panel is pressed into the door panel channel, it is resiliently engaged by the deflection arm which retains it in the door panel channel. A tongue on the mounting end locks into place behind the shoulder in the retainer channel to hold the retainer in the retainer channel.

23 Claims, 3 Drawing Sheets

PANEL DOOR FRAME ASSEMBLY

FIELD OF THE INVENTION

The present invention relates to frame hardware for panel-type doors and, more particularly, to an improved retainer and stile for holding the stile onto a door panel.

BACKGROUND OF THE INVENTION

Panel-type doors consisting of a single, generally flat door panel, appropriate frame hardware surrounding the panel and corner connectors holding the edge frame members together. Hinges connecting one side of the door to a doorway, or upper and lower tracks on which the door slides or rolls are typically used for opening mechanisms. Double doors are constructed in which one door slides to one side in front of or in back of another adjacent door, or in which the two doors are connected together by hinges so that they open by folding. This invention is primarily useful for the by-pass type sliding or rolling doors. It may also be used with swing doors or pocket doors.

The frame hardware for such panel-type doors includes horizontal rails and vertical stiles fitted onto the ends and sides respectively of the panel. The rails and stiles each have a channel that receives the edge of the panel and are interconnected at each corner by corner connectors positioned in back of the panel.

The stiles of such door panels must be stiff enough to minimize any twisting or bending that could release the panel from the stile. Any force exerted on the stile in a direction away from the panel such as to open or close a panel may pull the stile away from the panel. This may result in the panel coming out of the corresponding channel in the stile or in the stile becoming bowed. This problem is accentuated by heavy panels such as glass or mirror panels because the forces acting on the framing hardware are greater.

There is a need for stiles and rails to grip the panels firmly enough to prevent the panel from slipping out of the channel and also to add to the stiffness and rigidity of the overall door. This is partly aesthetic and partly functional. Since many panel-type doors are assembled by hand from purchased frame hardware and separately purchased panels, there is also a need for these doors to be quickly and easily assembled without any special tools and to be inexpensive and simple to construct.

BRIEF SUMMARY OF THE INVENTION

In one embodiment, the invention comprises a panel door stile and spring panel retainer in the stile for bearing against the back of a panel inserted into the stile and retaining the stile on the edge of the panel. The stile has a panel receiving channel adjacent to its front wall and a retainer channel behind the panel receiving channel. An elongated spring retainer fits in the retainer channel. The spring retainer has a portion which bears against two spaced apart portions of the back of the stile and a deflection arm having an end opposite a position between the spaced apart portions for bearing against the back face of a panel inserted into the panel receiving channel. Preferably the flattened generally C-shaped retainer has tongues which engage a shoulder inside the retainer channel for holding the retainer in the channel.

More specifically, the edge stile has a side wall, a front wall along the front edge of the side wall and a generally U-shaped channel formed from two internal walls extending substantially normal to the side wall One of the internal channel walls is spaced apart from the front wall enough to allow a door panel to be received in the space between the front wall and the channel wall. A retainer has a mounting end for inserting into the bight of the channel and a resilient deflection arm which extends from the retainer mounting end toward the front wall into the space between the front wall and the channel. The deflection arm resiliently engages a door panel inserted in the space between the front wall and the channel wall for retaining the door panel in place. The channel has a shoulder and the retainer has a resilient tongue for engaging the shoulder. The channel also has a heel protruding from the channel wall which is furthest from the front wall for contacting and supporting the retainer. The back of the edge stile has a support edge for supporting the other end of the retainer and supporting it against movement away from the space between the front wall and the channel.

BRIEF DESCRIPTION OF THE DRAWINGS

These and other features and advantages of the present invention will be better understood by reference to the following Detailed Description, when considered in conjunction with the accompanying drawings, wherein.

DETAILED DESCRIPTION

Figure 1:
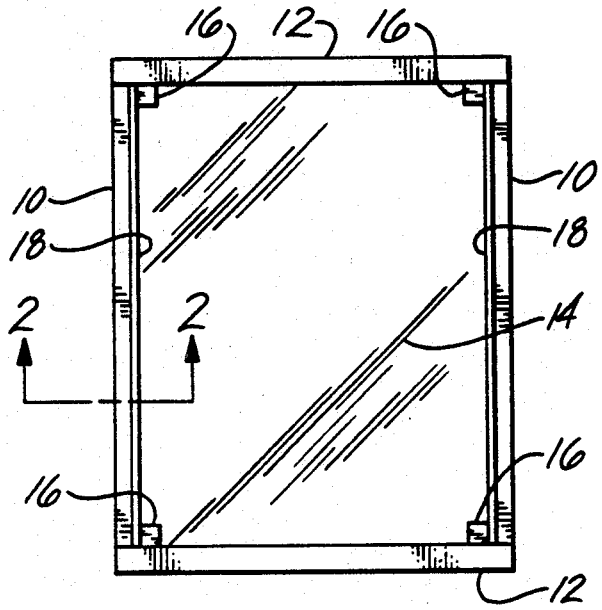
FIG. 1 is a face view of the back of a panel-type door incorporating the present invention.

The present invention is primarily intended for use on panel-type doors such as that illustrated in FIG. 1. Such a door has a vertical stile 10 at either side, a horizontal rail 12 at the top and bottom of the door and a door panel 14 such as a mirror. The stiles and rails are held together by corner connectors 16 illustrated schematically at each corner. A stile, rail and corner connector construction in part suitable for use with the present invention is shown, for example, in U.S. Pat. No. 3,750,337 to Brydolf et al. or U.S. Pat. No. 4,631,894 to Jerila.

The stiles and rails are preferably extruded from aluminum, while the corner connectors are stamped steel. The door panel can be constructed of a variety of materials, including wood, glass and plastic, and the door is typically intended for use as an interior door for a closet, or for a wardrobe or armoire. However, a great variety of other applications are possible with minor adaptations to the embodiments shown. In addition, the particular panel material selected can vary according to the application. For a typical sliding closet door, the corner connectors incorporate track guides at the top and rollers at the bottom to allow the door to slide and handle flanges 18 on each stile to allow the door to be grasped and moved to different positions.

Figure 2:
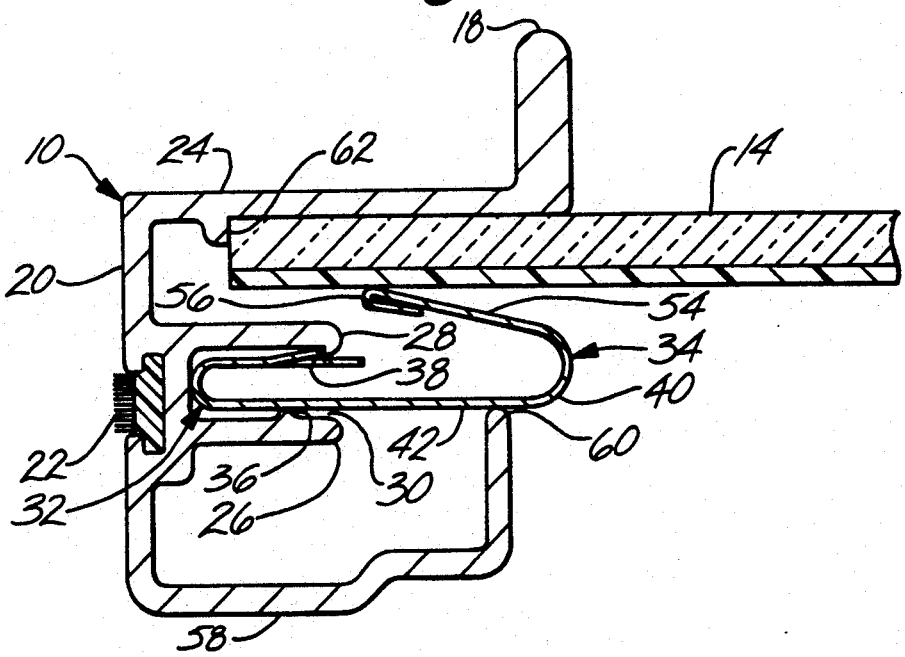
FIG. 2 is a cross-sectional view of a stile, retainer and door panel taken along line 2—2 in FIG. 1.

Referring to the transverse cross section in FIG. 2, the stile 10 has a rigid outer side wall 20 with a felt strip 22 to cushion the impact of the sliding door against the door jamb. A front wall 24 extends perpendicularly from or normal to the side wall and ends with the handle flange 18. This front wall provides a visual frame, as well as an actual frame for the door panel and is preferably as narrow as possible to reduce the visual impact of the frame on the door panel. A variety of decorative features may be incorporated in the front wall of the stile and the austere stile shown in the drawings is merely exemplary.

A pair of secondary interior walls 26, 28 also extend perpendicularly from the side wall and are spaced a distance away from the front wall 24. The two interior walls 26 and 28 define a channel 30 for receiving a mounting end 32 of a spring retainer 34. The space between the front interior wall 28 and the front wall 24 forms a second door panel channel which is large enough to allow a door panel 14 to slide into the space between the front wall and the retainer channel 30. The front wall preferably has a stop 62, an elongated edge running the length of the stile, against which the door panel rests when in position.

Inside the retainer channel is a heel 36 and a flange or shoulder 38 which interact with the retainer 34 when pressed fully into the bight of the channel, as will be described below.

The retainer is preferably formed from a roll formed sheet of steel to give it significant resilient spring-like properties and is elongated along the same axis as the stile. For a typical approximately 200 cm tall sliding closet door, a set of three elongated retainers are preferably used in each stile, each retainer measuring approximately 40 cm long. Three retainers are used for obtaining a desired spring retention force against the back of a panel with retainers having a length less than the total length of the stile.

Each retainer has a mounting end 32 and a deflection arm 40. The mounting end has a first substantially flat surface 42 which ends in a bent U-shaped surface 44 which winds up nearest the outer edge of the stile. A second, substantially flat surface 46 parallel to the first flat surface extends from the opposite end of the bent U-shaped surface back in the opposite direction. A tongue 48 extends outward from this second surface away from the first surface.

The deflection arm 40 extends from the first flat surface 42. The flat surface of the deflection arm ends in a curved portion 52 which is also U-shaped but does not form a complete 180 degree turn like the U-shaped surface of the mounting end. Instead, it forms a lesser turn and leads into a third flat surface 54. This third flat surface extends outward away from the U-shaped surface 52 and back towards the mounting end of the retainer. At the end of the second flat surface is a rounded contact edge 56 which again is substantially U-shaped, preferably forming a complete 180 degree turn back toward the U-shaped section 52 of the deflection arm.

Figure 3:
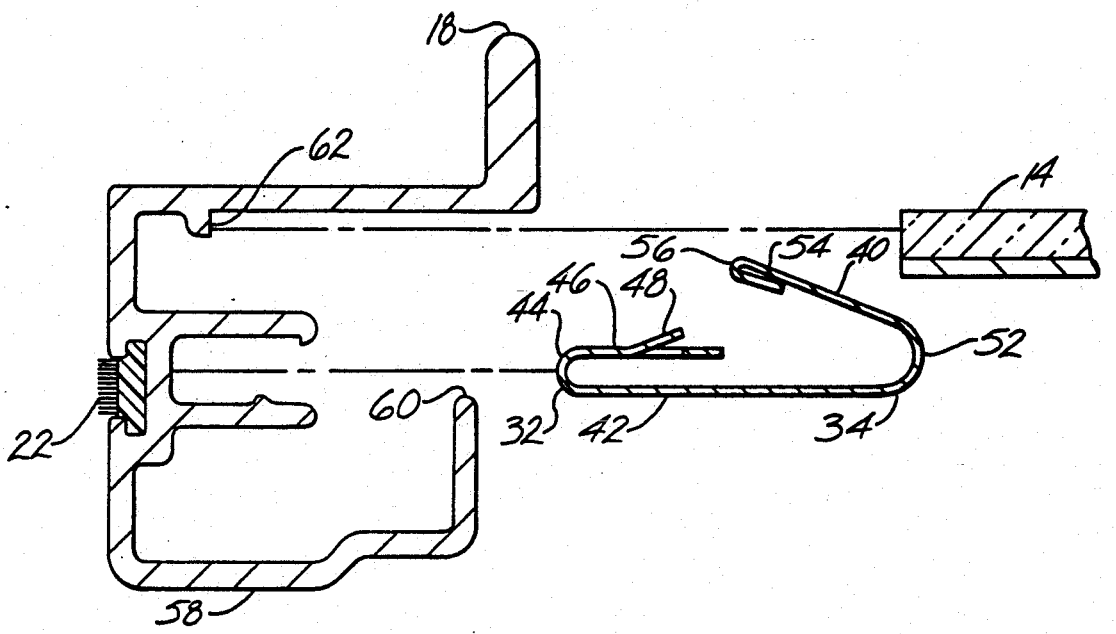
FIG. 3 is an exploded view of the components shown in FIG. 2.

As can be seen by comparing FIGS. 2 and 3, the retainer is resilient and is deformed somewhat when installed into the stile. The retainer is easily installed into the stile by pressing the mounting end 32 into the channel. This causes the first or central flat surface 42 of the mounting end 32 to contact the raised heel 36 in the retainer channel 30. Just as the flat surface is an elongated surface, the heel is an elongated edge shown in cross section in FIGS. 2 and 3. As the mounting end is pressed still further into the channel, the tongue 48 comes in contact with the outside of shoulder 38 in the channel and is depressed downwardly, bending the tongue and the second flat surface of the mounting end towards the first surface. As the mounting end is pressed still further, the tongue passes the flange and springs back upward into the position shown in FIG. 2.

At this point, the U-shaped surface 44 of the mounting end is in contact with or in close proximity to the bottom of the channel. The flange, heel and channel bottom cooperate to hold the retainer firmly in place inside the channel.

For manufacturing convenience, when the stile is extruded, the shoulder 38 is preferably an elongated edge which runs the entire length of the stile. The tongues on the spring retainer, however, are only stamped out along portions of the length of each retainer (see e.g. FIGS. 4 and 5). If the tongues are made too long along the length of the retainer, then the retainer becomes difficult to insert into the channel. If the tongues are made too short, then they will not be strong enough to hold the retainer in place. For a 40-cm long stamped steel retainer for use in an extruded aluminum stile, it is presently preferred that there be three tongues equally spaced apart from each other, each approximately 15 mm wide. The retainer is preferably insertable into the channel with a push of the hand or a rubber mallet, and an audible click is preferably heard when the tongue passes the shoulder, locking the retainer in place.

The stile has a fourth or rear wall 58 which also extends substantially perpendicular from the side wall 20 and has a curve which ends in a support edge 60 spaced a distance away from the top of the retainer channel. Preferably, as shown in FIGS. 2 and 3, the support edge 60 is further away from the side wall than the width of the retainer from the bottom of the retainer channel in the stile. The support edge 60 supports the first flat surface of the retainer so that the retainer cannot move away from the front wall when a door panel is pushed into position.

After the retainer is pushed into the retainer channel, the stile is pushed onto a door panel. Actually, the spring force may be high enough that it is difficult to push the stile on by hand and a rubber mallet may be used against the edge of the stile to force it on the panel. The door panel slides between the resilient deflection arm's rounded edge 56 into the channel formed by the front wall 24 and the front interior wall 28. The stile is pushed onto the edge of the panel until the panel engages the stop 62 inside the stile. As the stile is pushed into position, the door panel deflects the deflection arm away from the front wall toward the support edge 60. The resilient deflection arm presses outwardly from the retainer against the back wall of the door panel to hold the door panel in place, i.e. to hold the stile on the panel. The door panel can be removed simply by pulling the door panel and stile away from each other with sufficient force. The retainer can then be removed from the stile, if desired, by pushing it along the retainer channel out one end of the stile.

The force with which the deflection arm pushes the door panel against the front wall is determined by the angle of the deflection arm's second flat portion with respect to the first flat portion of the retainer, the thickness of the steel and the width of the deflection arm. It is presently preferred that this angle be between 10° and 25°. A smaller angle, for example 15°, allows the door panel to be installed and removed more easily, while a greater angle of, for example, 20° requires significantly more force. The particular angle selected may depend on the door panel material and thickness, the retainer material and thickness and the intended application for the finished door. The rounded edge 56 at the end of the deflection arm prevents the retainer from significantly marring the back surface of the door panel 14.

As can be seen in FIG. 2, when a door panel is installed in the frame assembly, the retainer is held in position at three points: the heel 36, the support edge 60 and the back of the door panel which contacts the end of the deflection arm 56. This three-point (actually three line) contact assures that the clip is well aligned and retained in a fixed position, even if the manufacturing tolerances of the parts are not great, significantly eliminating shaking and wobbling. The spring friction of the retainer against the panel contributes to the stiffness of the stile and prevents it from bowing when the handle is used to pull a door.

Thus, the retainer has a flattened generally C-shaped cross section with one end of the C extending into the retainer channel and the other end being outside the retainer channel. The retainer is positively held in the channel by the tongues engaging the internal shoulder on the stile. The deflection arm of the retainer has an edge outside the retainer channel extending across a portion of the panel receiving channel for engaging the back face of a panel and retaining it securely in the stile, i.e., retaining the stile on the panel.

Figure 4:
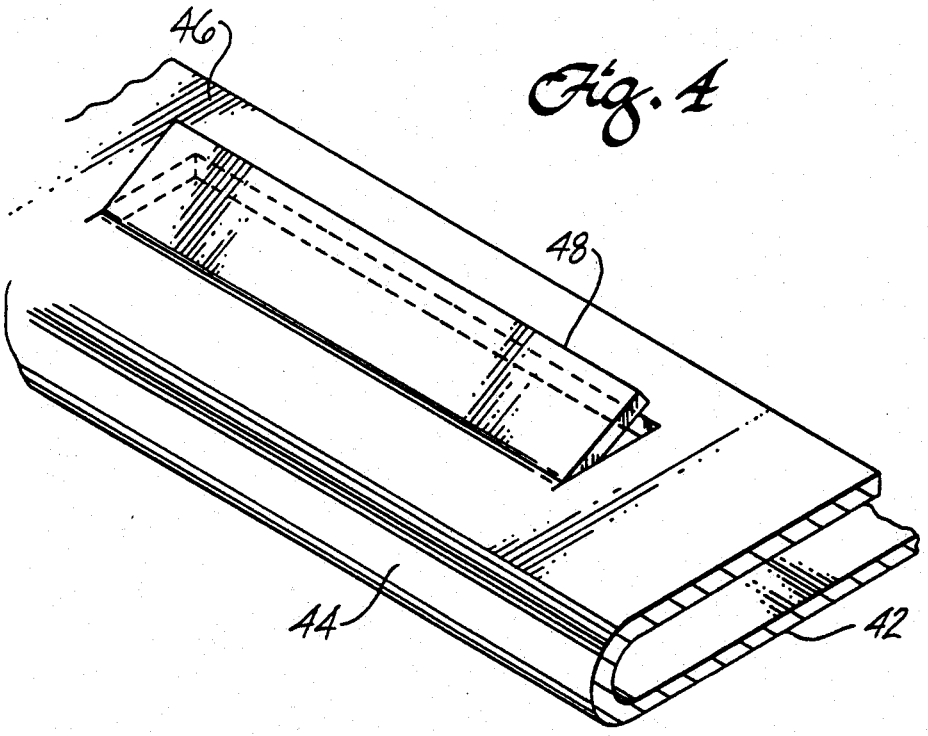
FIG. 4 is a perspective view of a portion of the retainer of FIG. 2 showing the tongue.
Figure 5:
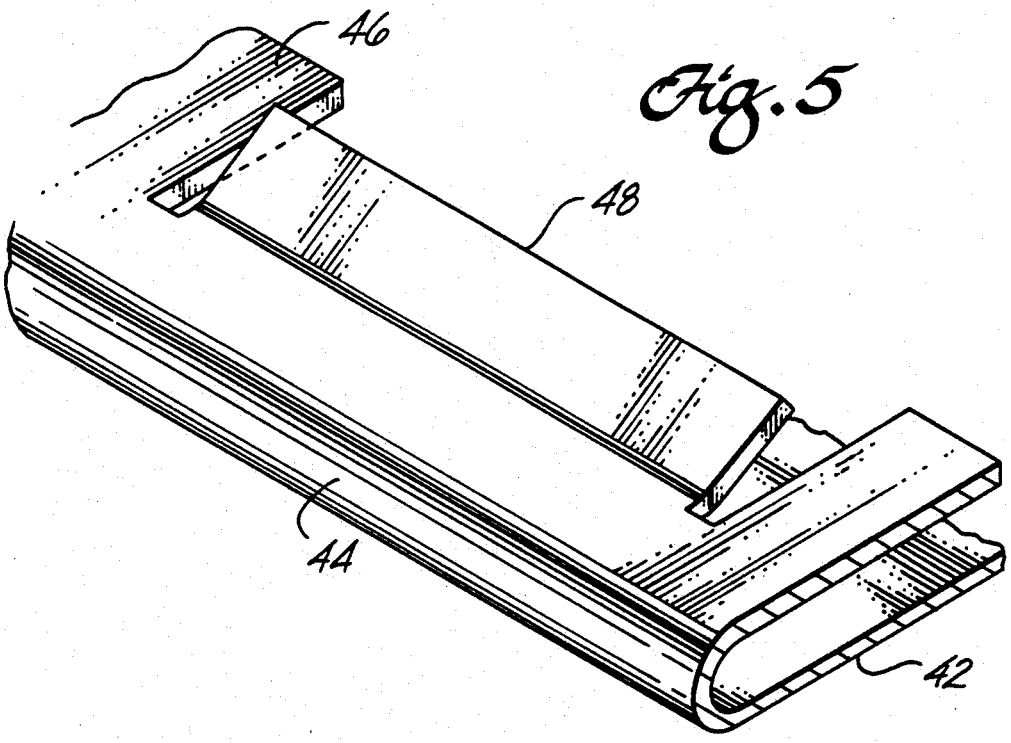
FIG. 5 is a view similar to that of FIG. 4 showing an alternate embodiment of the tongue.

The tongue which retains the retainer in its channel can be formed in a variety of ways. As illustrated in FIG. 4, the tongue may be formed by bending an edge portion of the second flat surface outwardly away from the first flat surface of the mounting end and cutting off the excess. In the embodiment illustrated in FIG. 5, the tongue is stamped and bent from a square panel in the material of the second flat surface.

A variety of other modifications and adaptations are possible without departing from the spirit and scope of the present invention. The door panels, stile and retainer may be constructed from a variety of materials, although it is preferred that the retainer be resilient. The heel, shoulder and tongue may be dispensed with, although it is preferred that some provision be made to hold the retainer into its channel until the door panel is slipped into position. The heel provides a certain location for the bearing of the retainer against the rearward portion of the stile, easing manufacturing tolerances and enhancing uniformity of the spring force applied by the retainer against the back of a panel.

The shape and configuration of the stile can be varied in many different ways, particularly for variations in appearance. Also, the stile may be provided with a second retainer channel and a flat rear wall to allow a second door panel to be mounted to the back surface of the stile so that opposite sides of the door present a different door panel surface. Although described for a panel door stile, the retainer may also be used in a rail, or for engaging panels in other frame and panel constructions. It is not intended to limit the scope of the present invention to the embodiment described above, but only by the claims below.

What is claimed is:

1. A stile and spring panel retainer for a panel door comprising:

an elongated stile having a front wall, a back wall, and a panel receiving channel adjacent to the front wall of the stile;

a retainer channel behind the panel receiving channel and having a front wall and a back wall; and an elongated spring retainer in the retainer channel, the spring retainer comprising:

a portion which bears against two spaced apart portions of the back wall of the retainer channel, and a deflection arm having an end opposite a position between the spaced apart portions for bearing against one face of a panel inserted into the panel receiving channel.

2. The stile and spring retainer of claim 1 wherein the retainer has a flattened generally C-shaped cross section with one end of the C extending into the retainer channel and the other end being outside the retainer channel, the deflection arm being an edge of the C outside the retainer channel extending across a portion of the panel receiving channel for engaging the back face of a panel.

3. The stile and spring retainer of claim 1 wherein the retainer has a length less than the length of the stile.

4. The stile and spring retainer of claim 1 comprising a shoulder within the retainer channel and wherein the retainer comprises a resilient tongue for engaging the shoulder for inhibiting removal of the retainer from the retainer channel.

5. The stile and spring retainer of claim 1 comprising a heel protruding from the back wall of the retainer channel and a support edge for contacting the retainer and supporting the retainer against movement away from the panel receiving channel.

6. A panel door comprising:

an edge frame member having a side wall;

a front wall along a front edge of the side wall;

a generally U-shaped channel formed from two interior walls extending substantially normal to the side wall, one of the interior walls being spaced apart from the front wall sufficiently to allow a door panel to be received in a space between the front wall and the interior wall; and a retainer having a mounting edge for insertion into the channel and a resilient deflection arm extending toward the front wall into the space between the front wall and the channel when the retainer is inserted in the channel for resiliently engaging a door panel when a door panel is received in the space between the front wall and the interior wall for retaining the door panel in said space.

7. The panel door of claim 6 wherein the mounting end comprises a first substantially flat surface connected to the deflection arm, a U-shaped section at the end of the first surface opposite the deflection arm and a second substantially flat surface substantially parallel to the first surface extending from the U-shaped section opposite the first surface.

8. The panel door of claim 7 wherein the channel comprises a shoulder and the retainer second surface comprises a resilient tongue for engaging the shoulder for holding the retainer in the channel.

9. The panel door of claim 8 wherein the tongue extends outwardly with respect to the channel when inserted into the channel.

10. The panel door of claim 9 wherein the tongue is formed from the retainer second surface by bending a portion of the second surface away from the remainder of the surface.

11. The panel door of claim 8 wherein the channel comprises a heel protruding from the channel wall farthest from the front wall for contacting and supporting the first surface of the retainer.

12. The panel door of claim 11 wherein the edge frame member comprises a support edge for contacting the retainer deflection arm and supporting the retainer against deflection away from the space between the front wall and the channel wall.

13. The panel door of claim 6 wherein the deflection arm comprises a first substantially flat portion extending from the mounting end, a U-shaped portion at the end of the first portion and a second substantially flat portion extending from the U-shaped portion opposite the first portion at an angle with respect to the first portion, the second portion being a sufficient size to extend into the space between the front wall and the channel wall.

14. The panel door of claim 13 wherein the second portion extends away from the first portion at an angle in the range of from 10° to 25° with respect to the first portion.

15. The panel door of claim 14 wherein the edge frame member comprises a support edge for contacting the retainer deflection arm and supporting the retainer against deflection away from the space between the front wall and the channel wall.

16. The panel door of claim 6 wherein the deflection arm comprises a smooth rounded contact edge for contacting the rear face of a door panel inserted into the space between the front wall and the channel wall.

17. A panel door frame comprising:

an edge frame member having a door panel channel for receiving a door panel, a retainer channel for receiving a retainer, the retainer channel having a heel projecting from an inner channel wall toward the door panel channel and a shoulder projecting from the inner channel wall opposite the heel, and a support edge facing the door panel channel; and a retainer having a mounting end for engaging the heel and the shoulder and a resilient deflection arm for engaging the support edge, the deflection arm extending into the door panel channel for resiliently engaging a door panel to retain the panel in the door panel channel.

18. The frame of claim 17 wherein the retainer mounting end comprises a first surface for engaging the heel and a tongue for engaging the shoulder, the tongue extending outward toward the channel opening for holding the retainer within the channel.

19. The frame of claim 18 the retainer mounting end comprises a extending substantially parallel to and to the first surface by a U-shaped surface a wherein the tongue extends from the second surface.

20. The frame of claim 17 the retainer deflection arm comprises a first substantially flat portion for engaging the support ed second portion angularly disposed with respect to and connected to the first portion for engaging a door panel.

21. A panel door comprising:

a flat panel having top and bottom edges and vertical side edges;

a rail along each of the top and bottom edges of the panel;

a generally U-shaped stile along each vertical edge of the panel, each stile comprising:

a first generally U-shaped channel inside the stile having walls spaced apart for receiving the door panel therebetween, a second generally U-shaped channel inside the stile beside the first channel, and a spring retainer having a portion inserted into the second channel with support against the stile in a portion of the stile away from the panel and a resilient deflection arm extending toward the panel for resiliently engaging a face of the door panel for retaining the door panel in the first channel, and wherein the spring retainer has a flattened generally C-shaped transverse cross section, the flattened portion of the cross section being adjacent the wall of the second channel and the deflection arm forming one leg of the C-shaped cross section.

22. A panel door comprising:

a flat panel;

a rail along each of the top and bottom edges of the panel;

a generally U-shaped stile along each vertical edge of the panel, each stile comprising:

a first generally U-shaped channel inside the stile having walls spaced apart for receiving the door panel therebetween, and a second generally U-shaped channel inside the stile beside the first channel; and a spring retainer having a length less than the length of the door and an edge inserted into the second channel with support against the stile in a portion away from the panel and a resilient deflection arm extending toward the panel for resiliently engaging a face of the door panel for retaining the door panel in the first channel.

23. A panel door comprising:

a flat panel having top and bottom edges and vertical side edges;

a rail along each of the top and bottom edges of the panel;

a generally U-shaped stile along each vertical edge of the panel, each stile comprising:

a first generally U-shaped channel inside the stile having walls spaced apart for receiving the door panel therebetween, and a second generally U-shaped channel inside the stile beside the first channel; and a spring retainer having a portion inserted into the second channel with support against the stile in a portion of the stile away from the panel and a resilient deflection arm extending toward the panel for resiliently engaging a face of the door panel for retaining the door panel in the first channel, and wherein the spring retainer engages a first portion of the stile near the opening of the U-shaped stile and a second portion of the stile remote from the first portion, the deflection arm engaging the face of the panel in a location between the first and second portions.

* * * * *

UNITED STATES PATENT AND TRADEMARK OFFICE

CERTIFICATE OF CORRECTION

PATENT NO. : 5,251,418

DATED : Oct. 12, 1993

INVENTOR(S) : Kenneth Jacobs, et al

It is certified that error appears in the above-indentified patent and that said Letters Patent is hereby corrected as shown below:

Column 7, lines 44-47, claim 19 should read as follows:

-- 19. The frame of claim 18 wherein the retainer mounting end comprises a second surface extending substantially parallel to and connected to the first surface by a U-shaped surface and wherein the tongue extends from the second surface.--

Column 7, lines 48-52, claim 20 should read as follows:

-- 20. The frame of claim 17 wherein the retainer deflection arm comprises a first substantially flat portion for engaging the support edge and a second portion angularly disposed with respect to and connected to the first portion for engaging a door panel. --

Signed and Sealed this

Fifth Day of July, 1994

Bruce Lehman

*Attest:*

BRUCE LEHMAN

*Attesting Officer*

*Commissioner of Patents and Trademarks*